United States Patent [19]

Scriven, Jr. et al.

[11] 3,989,239

[45] Nov. 2, 1976

[54] SHEET STACKING APPARATUS

[75] Inventors: Albert K. Scriven, Jr.; Michael F. Aulson, both of Beverly, Mass.

[73] Assignee: Speco, Inc., Beverly, Mass.

[22] Filed: Oct. 20, 1971

[21] Appl. No.: 190,897

[52] U.S. Cl. ..... 271/204; 198/796

[51] Int. Cl.[2] ..... B65H 29/04

[58] Field of Search ..... 271/63, 68, 79, 75, 271/20, 204, 206; 198/180, 76

[56] References Cited

UNITED STATES PATENTS

| | | | |
|---|---|---|---|
| 1,893,736 | 1/1933 | Federwitz | 271/79 |
| 2,262,631 | 11/1941 | Belluche | 271/79 X |
| 3,032,341 | 5/1962 | Reist | 271/79 |
| 3,321,202 | 5/1967 | Martin | 271/68 |
| 3,338,023 | 8/1967 | Lazenby | 198/40 X |

*Primary Examiner*—Evon C. Blunk
*Assistant Examiner*—Jeffrey V. Nase

[57] ABSTRACT

Sheets of material and more particularly irregularly shaped sheets, such as hides, fabric or plastic, are stacked on a platform by a structure which is positioned above the platform and to which the sheets are fed by a conveyor, into a pair of rollers which are pressed together to grip a sheet at the front edge of the sheet and drag it to the rear of the structure and release it onto a stack of sheets on the platform. The structure has a single continuous drive which carries the rollers and cams for closing and separating the rollers to grab and release the sheets at preselected points along the structure so that the sheets are laid one after another as they come up the conveyor in a stack on the platform.

2 Claims, 5 Drawing Figures

SHEET STACKING APPARATUS

The present invention relates to apparatus for moving sheets of material from a conveyor system to a stack and more particularly to apparatus for stacking the sheets on a platform.

In the process of treating hides or sheets of leather and other materials as well, the sheets are fed along a conveyor system through a continuous process, such as a drying process, spraying with dyes or coating. Then the sheets must be stacked to await further processing or for shipping. In either case, it is preferred to stack the sheets as fast as they come off the conveyor system into numerous stacks without slowing the system, and so as each stack is formed it must be moved away rapidly so another stack can start without interruption.

It is one object of the present invention to provide apparatus for stacking sheets on a platform as fast as the sheets are fed to the apparatus, to form stacks of the sheets that are readily removed when completed.

It is another object of the present invention to provide apparatus for stacking irregularly shaped sheets, one after another, in substantially uniform stacks.

It is another object of the present invention to provide apparatus for stacking sheets of material from a conveyor system in uniform stacks without interrupting the conveyor system.

It is another object to provide apparatus for carrying sheets of material from a conveyor system to a preselected point and dropping them.

The embodiment of the invention described herein, which is the best known use of the invention, is a structure to which sheets of material such as hides are fed from a conveyor system. The structure is positioned above a platform on which it stacks the sheets and includes two roller-like members on a continuous track that moves the members back and forth over the stack. One of the members is typically attached to the moving track and rides in a cam, which moves it against the other member to pick up a sheet and holds the members together while the sheet is dragged to the stack and then releases the sheet onto the stack in a continuous motion. In this embodiment, the structure rises steadily on a lift above the stack, as the height of the stack increases, and the drives for the track and the lift may be synchronized so that the rise occurs automatically.

Other objects and features of the present invention will be apparent in view of the following specific description, taken in conjunction with the figures, in which.

Figure 1:
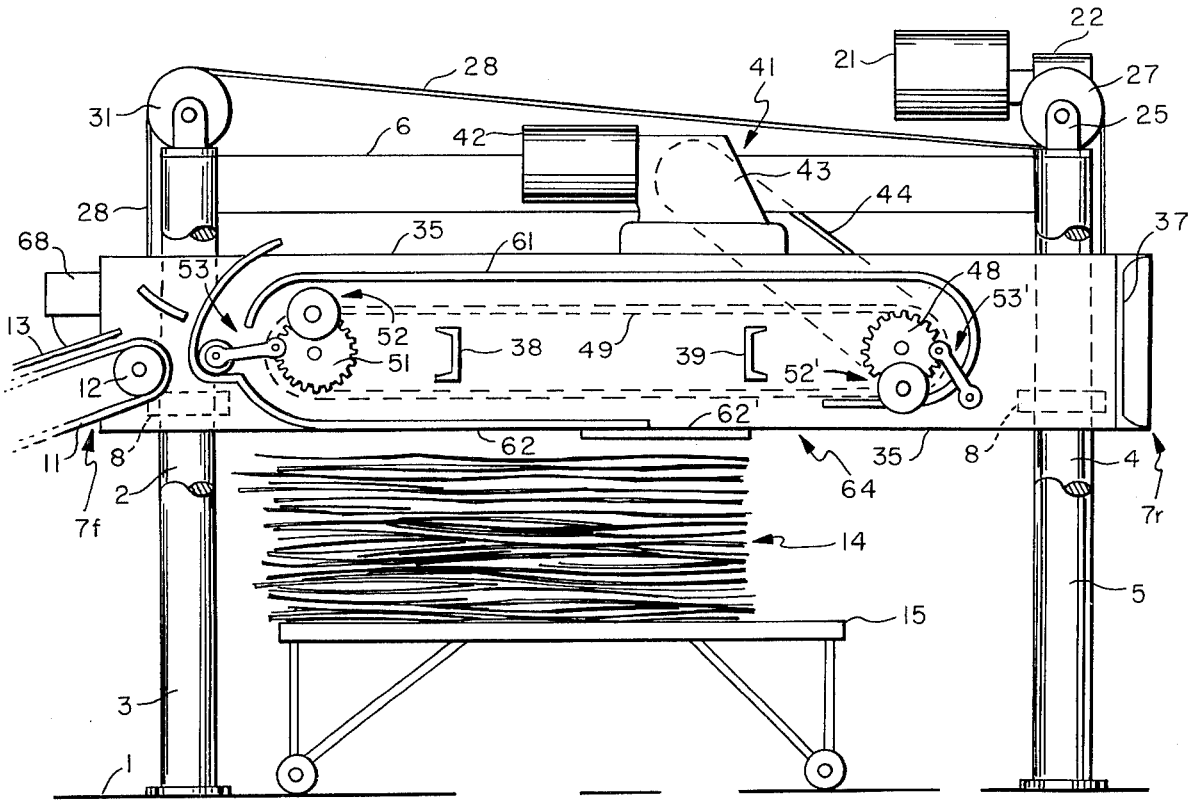
FIG. 1 is a side sectional view of the stacking apparatus, the section being taken as shown in FIG. 2.
Figure 2:
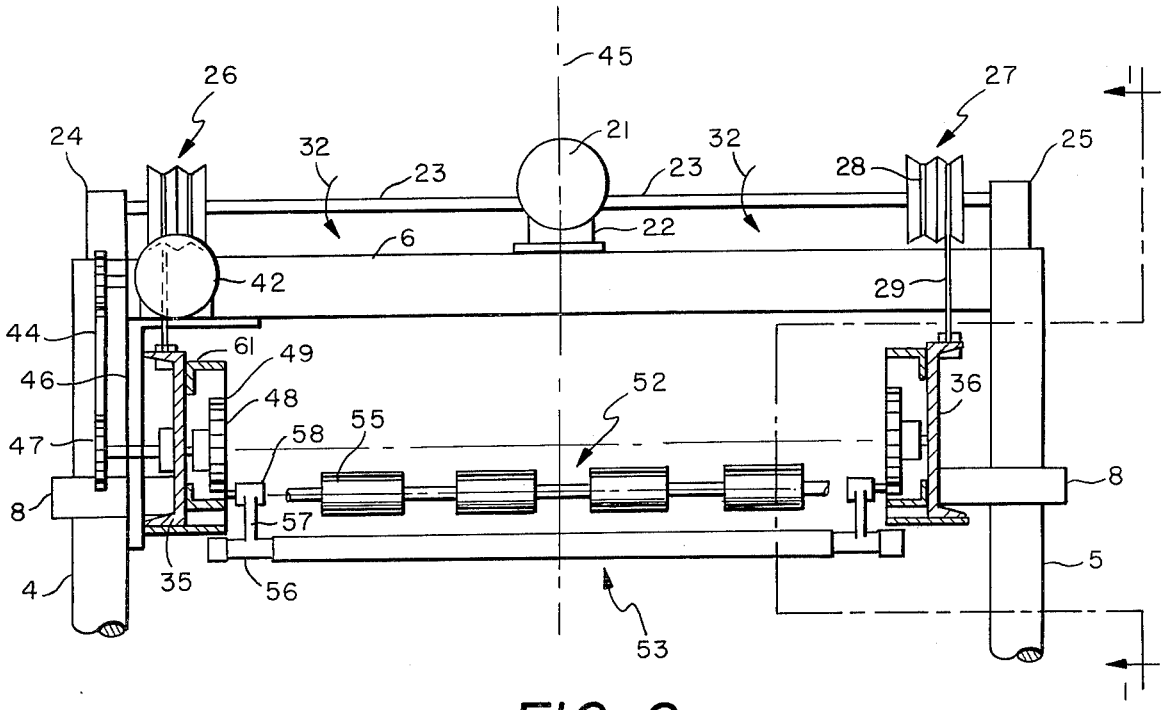
FIG. 2 is a front sectional view of the apparatus, the section being taken as shown in FIG. 5.

Apparatus for stacking sheets of material from a conveyor system, which embodies the principal features of the present invention and represents the best known use of the invention, is illustrated in FIGS. 1 and 2. As illustrated in FIG. 1, the apparatus stands on a floor 1, on four lift posts 2 to 5, which are preferably vertical standing cylinders attached to the floor and connected at their tops by the rectangular frame 6, and so the posts are rigidly secured to each other at both ends and to the floor. The sheet carrier assembly 7 rides up and down on these posts and may contain bearings such as 8 at each corner to facilitate the movement up and down the posts. At the front end **7*f* of the carrier assembly, a conveyor system 9 meets the assembly. This may includes a conveyor belt 11 and idler 12, which is attached to the carrier assembly, and so the end of the conveyor is fixed relative to the carrier assembly. In operation, the carrier assembly accepts sheets such as 13 as fast as they are fed off the conveyor and carries them to a stack beneath the carrier. This stack of sheets 14 is formed directly beneath the carrier between the posts and may be formed on a cart such as cart 15, or may be formed on a second conveyor system moving beneath the carrier and which conveys stacks of the sheets rather than single sheets. For purposes of illustration, a cart is shown on which the stacks are formed. These carts are rolled out from under the carrier assembly as each stack is completed and an empty cart is quickly inserted. This can usually be done without stopping or slowing the conveyor 9**.

As the stack grows on the cart beneath the carrier assembly, the assembly moves up the posts. A lift system for driving the assembly up the posts includes a lift drive motor 21, mounted on the frame 6 with a gear box 22, through which the motor drives the lift drive shaft 23. The drive shaft is carried by the gear box and left and right bearings 24 and 25 also are mounted on the frame 6. On this shaft are fixed the left and right rear pulleys 26 and 27, to which the front and rear lift cables such as 28 and 29 are attached. A front and rear cable extend from each of the rear pulley combinations 26 and 27. Each front cable such as 28 rides over a front pulley, such as 31, to the front of the carrier assembly and a rear cable, such as 29, is attached to the rear, **7*r*, of the carrier assembly. Thus, when the motor drives the shaft 23 in the direction of arrows 32, all four cables pull evenly raising the carrier assembly 7** on the posts.

The carrier assembly 7 includes structure which grips the front edge of a sheet coming off the conveyor 9 and drags the sheet across the stack 14 and releases it on the stack, with the front edges of all sheets in the stack substantially aligned. The carrier assembly 7 includes left and right side channels 35 and 36, rear channel 37, and two or more cross channels, such as 38 and 39, forming a rigid structure. This rigid structure carries the mechanism for dragging a sheet from the conveyor onto the stack beneath and the drive for the mechanism. The drive 41, includes a motor 42, gear box 43 and pulley 44. The drive system 41 drives symmetrical mechanisms mounted on the inside of the left and right side channels 35 and 36. These mechanisms are substantially symmetrical with respect to the center line 45 in FIG. 2, and so only the parts shown in FIG. 1 carried by the left side channel 35 will be described below.

The left side channel 35 carries the drive system 41 on motor mount 46. The belt 44 drives pulley 47, which is directly connected to the rear sprocket 48. This sprocket drives a continuous chain 49, carried also by the front idler sprocket 51. To this chain are attached the two roller members, the carrier roller 52, and the locking roller member 53. The carrier roller member 52 is preferably fixedly attached to the chain on its shaft 54 and has resilient sections such as 55, spaced along the shaft for gripping the front edge of a sheet from the conveyor 9. The locking roller member, also called the cam follower, includes a shaft 56, with an arm such as 57, at each end, extending from the shaft to an axle 58, that pivotally attaches to the chain 49, the point of attachment to the chain being fixed. Thus, the two roller members are not fixed on the chain relative to each other. However, the axis of the carrier roller (also called the first roller) and the axle of the locking roller member (also called the second roller member) are fixed with respect to each other on the chain 49.

The pivotal position of the locking roller member, with reference to the chain, is determined by the cams 61 and 62. These are the upper and lower cams, respectively. These cams overlap at the front the structure, but do not overlap at the rear and in fact there is a space 64 between the cams at the rear of the structure, along which there is no cam action exerted on the locking roller.

More than one combination of carrying roller and locking roller can be included on the chain 49. For purposes of illustration here, two combinations are shown, disposed at opposite ends of the chain and so while one pair of rollers is preparing to pick up a sheet from the conveyor 9, the other pair is releasing a sheet onto the stack 14. If two combinations of rollers are mounted on the chain, then it is most practical to mount them at opposite positions on the chain. However, this is not an absolute requirement. As a general rule, the combinations of rollers along the chain can be spaced no closer together than the length of a typical sheet. If they are spaced closer than the lengths of the sheets, then it is quite likely that a sheet dragged from the conveyor will not clear the conveyor before the next pair of rollers arrives at the front end of the structure, ready to pick up the next sheet. The carrier and locking rollers of one pair are referred to herein as 52 and 53, respectively, and the carrier and locking rollers of the other pair are referred to as 52' and 53', respectively.

Figure 3:
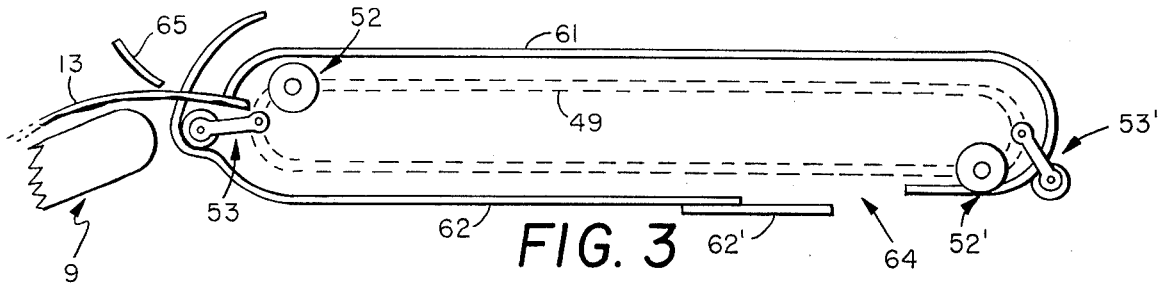
FIGS. 3, 4 and 5 illustrate the interaction between the roller members, which receive a sheet from the conveyor system, grasp the sheet at the front edge of the sheet, drag it across a stack beneath the apparatus and release the sheet onto the stack.
Figure 4:
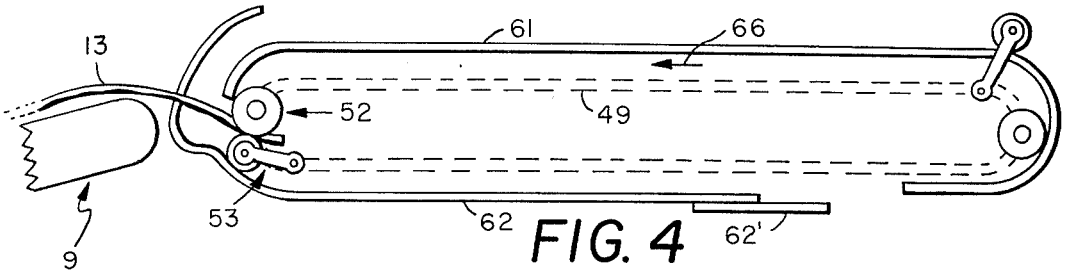
Figure 5:
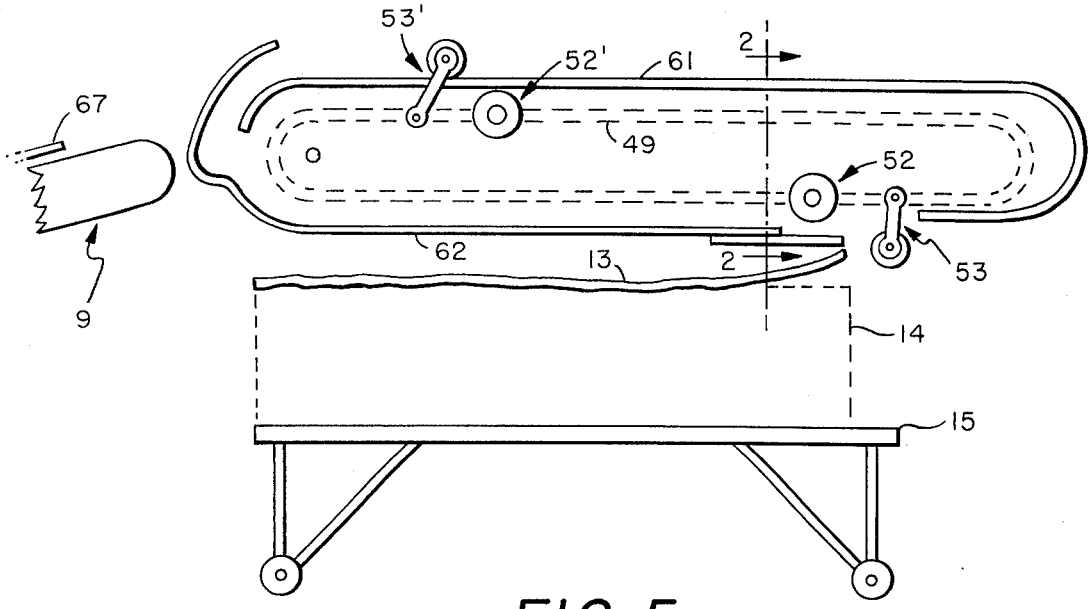

The operation and function of the rollers, cams and drive chain to grab the front edge of a sheet from the conveyor and drag it across the stack beneath the structure, is illustrated in sequence by the FIGS. 3, 4 and 5. FIG. 3 shows the rollers 52 and 53 at the front end of the structure, separated or opened with respect to each other and ready to receive the front edge of a sheet 13. The front edge of the sheet guided by the vane 65 attached to the front of the structure is inserted from the conveyor 9 between the two rollers, which may be accomplished while the chain 49 is driving the rollers or the drive 49 may halt for a moment while the conveyor drives the sheet between the rollers. Meanwhile, the other pair of rollers 53' and 54' are positioned at the rear of the structure as shown. Next, as shown in FIG. 4, the chain drives in the direction of arrow 66 moving the roller 53 off of cam 61 and onto the front end of cam 62, which pivots the roller 53 about its axle 58, pressing it against the resilient parts 55 of roller 52, so that the front edge of the sheet 13 is securely gripped in between, as shown in FIG. 4. As the chain continues to drive in the direction of arrow 6, rollers 52 and 53 remain closed, gripping the sheet 13 and dragging it toward the rear of the structure, over the stack 14. By the time roller 53 reaches the opening 64, at the end of cam 62, the sheet 13 will have cleared the end of the conveyor 9 and will be in a proper position on the stack 14. When roller 53 reaches the opening 64, it is released and swings by gravity away from roller 52, releasing the sheet as shown in FIG. 5. Meanwhile, the other two rollers 52' and 53' approaching the front of the structure will repeat this action, picking up the next sheet 66 on the conveyor. The position of the opening 64 can be adjusted by positioning the extension 62' of cam 62. This adjusts the position along the path at which the sheet is released onto the stack.

The conveyor 9 and the drive 41 are preferably synchronized, in order to assure that a pair of rollers are properly positioned at the front of the structure to receive a sheet from the conveyor. For this purpose, a detector such as detector 68 mounted on the front of the structure detects the passing of the front edge of a sheet, such as the sheet 13. At this point, the pair of rollers 52 and 53 should be at the position shown in FIG. 3, in readiness to receive the front edge of the sheet a given interval after the edge is detected. If this is not the case, and the rollers are not at this position, the carrier drive 41 increases or decreases speed to move the rollers to the proper relative position. The given interval mentioned is calculated to allow the conveyor to insert the front edge of the sheet fully into the space between the two rollers. With this sort of control synchronizing the drive 41 with the conveyor 9, sheets of irregular size can be readily handled and stacked automatically.

Furthermore, the interval can be set so that a substantial amount of the sheet will pass over roller 53 before the drive 41 is initiated which in effect turns the sheet over before it is stacked. In an embodiment of the present invention where the sheets are engaged by the front edge only the process is called stacking and where the sheets are turned over everytime it is called turning. If the sheets are alternately stacked and turned automatically, it is called facing. All of these methods can be at the operator's selection by suitable controls provided for synchronizing the carrier drive 41 with the detection of the front edge of the sheets on the conveyor.

The lift motor 21 is preferably synchronized with the drive 41, so that it lifts the carrier assembly 7 a predetermined distance to maintain proper clearance between the bottom of the carrier and the top of the stack forming beneath the carrier.

The specific embodiment of the present invention described herein represents the best known use of all the disclosed features of the invention. Various modifications of these will be apparent to those skilled in the art, without departing from the spirit and scope of the invention as set forth in the appended claims.

What is claimed is:

1. Apparatus for stacking sheets on a platform comprising, a structure positionable above the platform having front and rear ends and sides, a first member in the structure having a longitudinal axis which extends from side to side therein, a second member in the structure having a longitudinal axis which extends from side to side therein parallel to the axis of the first member, a driven chain for moving said members together from the front to the rear and from the rear to the front of the structure over a closed path, the first member being fixedly attached to the chain and the second member being pivotally attached to the chain so as to pivot relative to the chain on an axis parallel to said member longitudinal axes, top and bottom cam tracks which are substantially parallel to the drive path and fixed to the structure, said second member riding on top of said cam tracks and engaging the bottom cam track at the front of the structure causing the second member to pivot against the first member, said bottom cam track extending toward the rear of the structure to a point where the second member leaves the bottom cam track and engages the top cam track, whereby the members close at the front and separate when the second member reaches said point as both members approach the rear from the front of the structure, and means for inserting a sheet between the members before they are closed at the front, whereby the sheet is carried by the members to the rear and released on the platform.

2. Apparatus as in claim 1 wherein, matching top and bottom cam tracks are attached to each of the sides of the structure.

* * * * *